US009870884B2

(12) United States Patent
Terada et al.

(10) Patent No.: US 9,870,884 B2
(45) Date of Patent: Jan. 16, 2018

(54) GAS CIRCUIT BREAKER

(71) Applicant: Hitachi, Ltd., Chiyoda-ku, Tokyo (JP)

(72) Inventors: Masanao Terada, Tokyo (JP); Hajime Urai, Tokyo (JP); Daisuke Ebisawa, Tokyo (JP); Hiroaki Hashimoto, Tokyo (JP); Riichi Nagao, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/467,384

(22) Filed: Mar. 23, 2017

(65) Prior Publication Data

US 2017/0278654 A1 Sep. 28, 2017

(30) Foreign Application Priority Data

Mar. 28, 2016 (JP) ..... 2016-063307

(51) Int. Cl.
*H01H 33/42* (2006.01)
*H01H 33/64* (2006.01)
*H01H 33/56* (2006.01)

(52) U.S. Cl.
CPC ..... *H01H 33/42* (2013.01); *H01H 33/56* (2013.01); *H01H 33/64* (2013.01)

(58) Field of Classification Search
CPC ..... H01H 2009/0022; H01H 9/0016; H01H 9/0038; H01H 2009/0055; H01H 2205/002; H01H 33/42; H01H 33/6661; H01H 3/3052; H01H 3/40; H01H 3/44; H01H 9/0027; H01H 9/0033; H01H 9/0044
See application file for complete search history.

(56) References Cited

U.S. PATENT DOCUMENTS 6,271,494 B1 8/2001 Dienemann et al.
9,748,059 B2 * 8/2017 Cernat ..... H01H 33/025
2016/0203927 A1 * 7/2016 Terada ..... H01H 33/42 218/154

FOREIGN PATENT DOCUMENTS

JP 2003-109480 A 4/2003

* cited by examiner

*Primary Examiner* — Truc Nguyen
(74) *Attorney, Agent, or Firm* — Crowell & Moring LLP

(57) ABSTRACT

To provide a gas circuit breaker having a space-saving and highly reliable double motion mechanism with high design freedom. In a double motion mechanism of the gas circuit breaker, a driven side movable pin is communicated with a lever driven side hole cut in the opposite side with respect to a rotation axis of a lever. A round hole through which a driving side movable pin is inserted and an elongate hole through which the driven side movable pin is inserted are cut in the outside of the lever. A position retaining member to suppress rotation of the driving side movable pin about two axes vertical to a pin axis is provided. The driving side movable pin is moved in respective grooved cams with an operation of the driving side rod, to rotate the lever, drive the driven side connecting rod in an opposite direction to the driving side connecting rod, and drive the driven side arcing contact in an opposite direction to the driving side arcing contact.

14 Claims, 6 Drawing Sheets

GAS CIRCUIT BREAKER

TECHNICAL FIELD

The present invention relates to a gas circuit breaker, and more particularly, to a gas circuit breaker to which a double motion mechanism to drive electrodes in mutually opposite directions is applied.

BACKGROUND ART

As a gas circuit breaker used in a high-voltage electric system, a so-called puffer type gas circuit breaker is generally used. It utilizes rise of extinguishing gas pressure in the middle of opening to cut off an electric current by blowing compressed gas against arc caused between the electrodes. To improve the breaking performance of the puffer type gas circuit breaker, a double motion method to drive a conventionally-fixed driven side electrode in an opposite direction to a driving direction of the driving side electrode, is proposed.

For example, Patent Literature 1 proposes a method using a fork-shaped lever. According to this invention, practically, when a pin interlocked with the movement of the driving side comes into contact with a depression of the fork, the fork-shaped lever is rotated. The rotation is converted into reciprocating motion in an opening/closing axis direction, to drive the driven side arcing contact in an opposite direction to a driving direction of the driving side electrode. In a state where the pin is away from the depression of the fork, the position of the lever is maintained, and the driven side arcing contact stands still.

Further, Patent Literature 2 discloses a gas circuit breaker in which "a grooved cam having a groove is fixed to the connecting rod. A connecting pin of a link mechanism is slidably engaged and slid in the groove, with which a link is rotated, to displace an opposing arcing contact in an opposite direction to a moving direction of the movable arcing contact." (See Abstract).

CITATION LIST

Patent Literature

Patent Literature 1: U.S. Pat. No. 6,271,494

Patent Literature 2: Japanese Unexamined Patent Application Publication No. 2003-109480

SUMMARY OF INVENTION

Technical Problem

However, since the shape of the fork-shaped lever disclosed in Patent Literature 1 is formed only with a linear portion and an arc portion, it is impossible to arbitrarily set the speed on the driven side. Further, it is conceivable that, upon each opening/closing operation, the pin comes into contact only with the depression of the fork-shaped lever, and the fork-shaped lever receives an excessive force.

According to Patent Literature 2, the speed on the driven side is arbitrarily set with the grooved cam. The grooved cam has an approximately arc shape, and the driven side always operates in accordance with motion on the driving side. Accordingly, it is not possible without difficulty to limit the motion on the driven side within a desired time region. Further, since the grooved cam has an approximately arc shape, the device size is large.

In view of the above problems, the present invention has an object to realize a space-saving, highly reliable double motion mechanism having high design freedom.

Solution to Problem

According to a solution in the present invention, there is provided a gas circuit breaker comprising:

a driving side electrode, having a driving side main electrode (2) and a driving side arcing contact (4), connected to an operating unit (1), and provided in a closed tank (100);

a driven side electrode, having a driven side main electrode (3) and a driven side arcing contact (5), being provided oppositely to the driving side electrode in the closed tank (100); and a double motion mechanism (10), wherein the double motion mechanism (10) has:

a driving side connecting rod (11), with a cut-in first grooved cam (16), that receives a driving force from the driving side electrode;

a driven side connecting rod (13) connected to the driven side arcing contact (5);

a guide (14), with a cut-in second grooved cam (17), that holds the driving side connecting rod (11) and the driven side connecting rod (13) to move inside;

two levers (12), with a cut-in third grooved cam (19) and a round lever driven side hole (27), provided on the both outer sides of the guide (14), to connect the driven side connecting rod (13) and the driving side connecting rod (11), and operate the driven side connecting rod (13) in an opposite direction with respect to an operation of the driving side connecting rod (11);

a lever fixing pin (15) to fix the two levers (12) mutually rotatably;

a driving side movable pin (18) communicated with the first grooved cam (16) of the driving side connecting rod (11), the second grooved cam (17) of the guide (14), and the third grooved cam (19) of the respective two levers (12);

a driven side movable pin (20) communicated with the lever driven side hole (27) in a position on the opposite side to the driving side movable pin (18) with the lever fixing pin (15) between the pins; and two position retaining members (22), respectively provided on the outer side of the two levers (12), with a cut-in round hole (31) through which the driving side movable pin (18) is inserted and an elongate hole (32) through which the driven side movable pin (20) is inserted, to suppress rotation of the driving side movable pin (18) about two axes vertical to a pin axis.

Advantageous Effects of Invention

According to the present invention, it is possible to realize a space-saving, highly reliable double motion mechanism having high design freedom.

DESCRIPTION OF EMBODIMENT

Hereinbelow, a gas circuit breaker according to an embodiment of the present invention will be described with reference to the drawings. Note that the following description is merely an example of implementation, and not intended to limit the contents of the invention to the following particular aspects. It is possible to implement the invention itself in various aspects in accordance with contents described in the claims. In the following embodiment, an example of a breaker having a mechanical compression chamber and a thermal expansion chamber will be given. However, the present invention and/or the present embodiment is applicable to a breaker with only a mechanical compression chamber.

A. Outline

In the present embodiment, for example, a first grooved cam, having an arbitrary curve in a driving side connecting rod connected to the driving side and operated in accordance with driving side operation and a linear portion, a second grooved cam, intersecting the first grooved cam, cut in a fixed guide plate holding the driving side connecting rod from both sides, and grooves cut in two same-shaped levers provided outside the guide plate, are communicated with a driving side movable pin. A round hole cut on the opposite side with respect to the rotary axis of the lever is communicated with a driven side movable pin. A round hole to pass the driving side movable pin through and an elongate hole to pass the driven side movable pin through are cut outside the lever. A position retaining member to suppress rotation of the driving side movable pin about two axes vertical to the pin axis is provided. The lever is rotated about the rotary axis in accordance with movement of the driving side movable pin, to move a driven side electrode in an opposite direction to the driving side. It is possible to variably or arbitrary design the speed ratio between the driving side and the driven side, and it is possible to realize intermittent drive.

According to the present invention, it is possible to prevent/suppress stagnation/breakage of a double motion mechanism by retaining the position of the pin that moves in the grooved cam in the double motion mechanism.

Further, according to the present embodiment, it is possible to realize a grooved cam shape to minimize energy of an operating unit while ensure breaking performance. It is possible to reduce the operating energy in comparison with the conventional double motion method.

B. Gas Circuit Breaker

Figure 2:
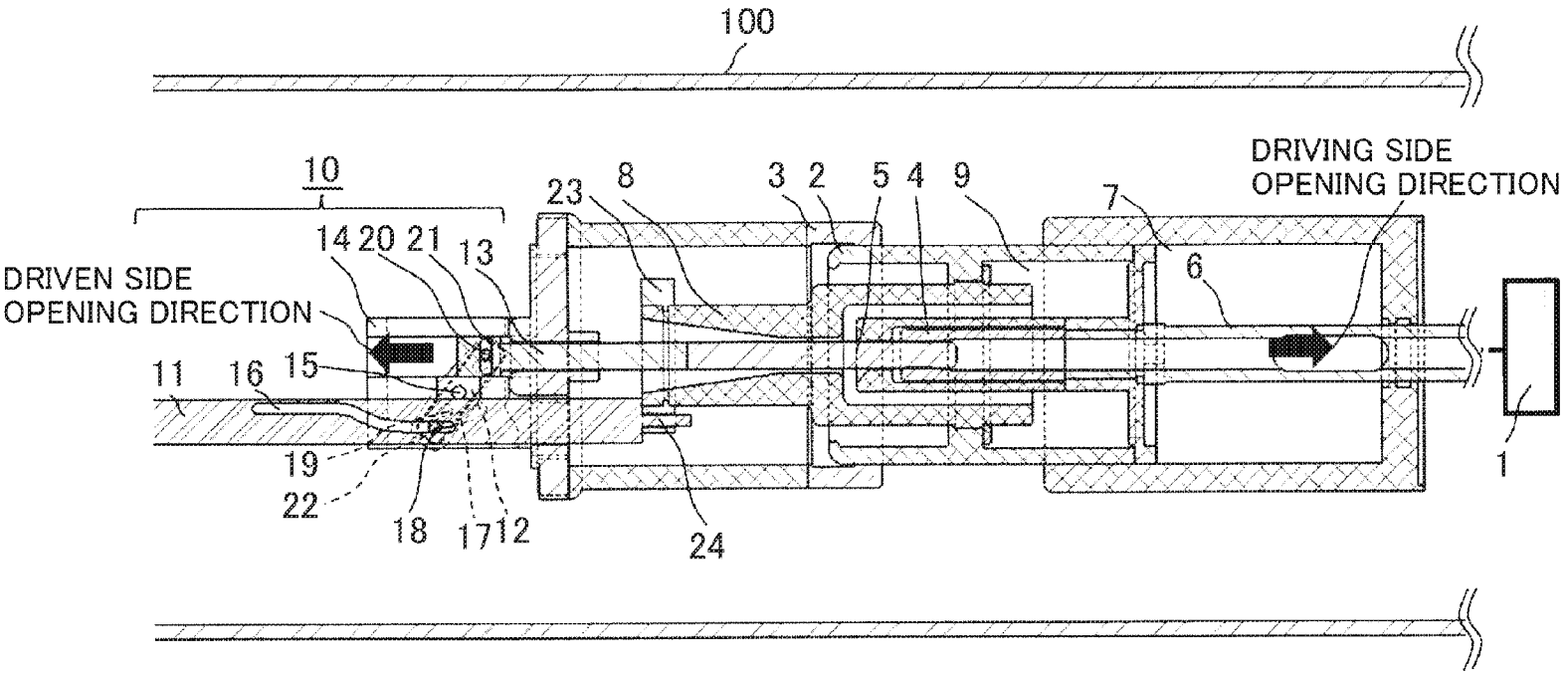
FIG. 2 is a diagram showing a closed state of the gas circuit breaker according to the embodiment of the present invention.

FIG. 2 shows an On-state of the gas circuit breaker in the embodiment of the present invention.

A driving electrode and a driven electrode are provided coaxially and oppositely in a closed tank 100. The driving side electrode has a driving side main electrode 2 and a driving side arcing contact 4. The driven electrode has a driven side main electrode 3 and a driven side arcing contact 5.

An operating unit 1 is provided adjacently to the closed tank 100. A shaft 6 is connected to the operating unit 1. The driving side arcing contact 4 is provided at the end of the shaft 6. The shaft 6 and the driving side arcing contact 4 are provided through a mechanical compression chamber 7 and a thermal expansion chamber 9.

The driving side main electrode 2 and a nozzle 8 are provided on the breaking part side of the thermal expansion chamber 9. The driven side arcing contact 5 is provided coaxially and oppositely to the driving side arcing contact 4. One end of the driven side arcing contact 5 and the end of the nozzle 8 are connected to a double motion mechanism 10.

As shown in FIG. 2, the gas circuit breaker when in the On state is set in a position to bring the driving side main electrode 2 and the driven side main electrode 3 into conduction with a driving source such as hydraulic pressure or spring of the operating unit 1, and forms a circuit of an electric power system at normal time.

Upon breaking of an electric current such as a short circuit current by lightning strike or the like, the operating unit 1 is driven in an opening direction, to separate the driving side main electrode 2 and the driven side main electrode 3 away from each other via the shaft 6. At that time, arc is generated between the driving side arcing contact 4 and the driven side arcing contact 5. The electric current is cut off by mechanical extinguishing gas blowing with the mechanical compression chamber 7 and by extinguishing gas blowing utilizing arc heat with the thermal expansion chamber 9.

To reduce the operating energy of this puffer type gas circuit breaker, the double motion mechanism 10 to drive the conventionally-fixed driven side arcing contact in an opposite direction to a driving direction of the driving side electrode is provided.

Hereinbelow, the double motion method will be described based on FIG. 1.

Figure 1:
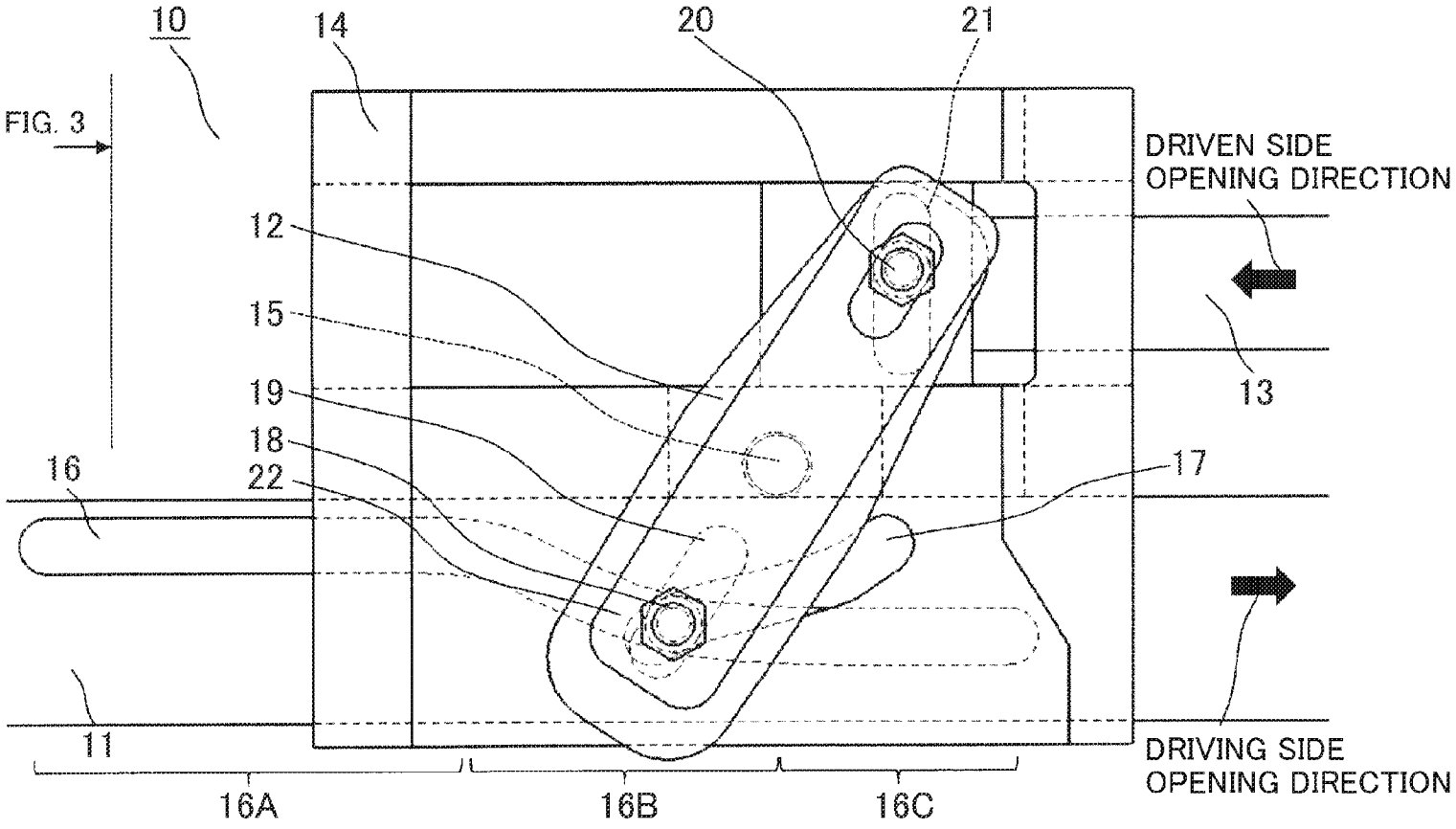
FIG. 1 is a detail view of a double motion mechanism of a gas circuit breaker according to an embodiment of the present invention.

FIG. 1 is a detailed view of the double motion mechanism of the gas circuit breaker according to the embodiment of the present invention.

As shown in FIG. 1, the double motion mechanism 10 in the present embodiment is formed by connecting the driven side connecting rod 13 and the driving side connecting rod 11 with a lever 12 rotatably provided on a guide 14 while holding the driven side connecting rod 13 and the driving side connecting rod 11 with the guide 14 movably in a breaking operation direction.

A first grooved cam 16 is cut in the driving side connecting rod 11. The first grooved cam 16, viewed from the operating unit side, has a second linear portion 16C, a connecting portion 16B, and a first linear portion 16A. The first linear portion 16A and the second linear portion 16C are provided on mutually different axis lines, and the connecting portion 16B is provided between them. It is configured such that the displacement range of the first grooved cam 16 in a vertical direction is within the displacement range of the second grooved cam 17 in the vertical direction and the displacement range of the third grooved cam 19 in the vertical direction. Note that it is conceivable that the shape of the connecting portion 16B is arbitrarily designed in correspondence with the operation characteristic of the breaking part. For example, it may have a curve or a linear shape.

The displacement of the driving side connecting rod 11 in an up-and-down direction is limited with the driving side guide 29 (see FIG. 4) as a groove provided in the guide 14. It is movable only in the operating axis of the breaking part and a horizontal direction.

As shown in FIG. 1, the second grooved cam 17 formed with, e.g., a curve is cut in the guide 14 equivalently to the width of the first grooved cam 16 in the up-and-down direction. Note that the shape of the second grooved cam 17 is not limited to the curve, but is arbitrarily changed in correspondence with breaking operation characteristic. The first grooved cam 16 and the second grooved cam 17 form a laminated structure in the vertical direction in the sheet. A driving side movable pin 18 is provided in an overlapped part between the both grooved cams, and the cams are mutually rotatably connected (see FIG. 4).

Further, the driving side movable pin 18 is inserted through a third grooved cam 19 cut in the lever 12. The lever 12 is rotated with a lever fixing pin 15 as a rotation axis. At this time, the driving side movable pin 18, when it moves on the connecting portion 16B of the first grooved cam, it moves in the second grooved cam 17 while turning in one direction. With this one-direction movement of the driving side movable pin 18, a force acts on one side of the inner wall of the third grooved cam 19, to regulate the rotation direction of the lever 12. Note that the shape of the third grooved cam 19 is not particularly limited, but maybe arbitrarily changed in correspondence with breaking operation characteristic.

With this rotation movement, the driven side movable pin 20 attached to the lever 12 transmits the force to the guide groove 21 cut in the driven side connecting rod 13, to drive the driven side connecting rod 13 connected to the driven side arcing contact 5 in the opposite direction to the driving side connecting rod 11.

The displacement of the driven side connecting rod 13 in the up-and-down direction is limited with the driven side guide 30 (see FIG. 4) as a groove provided in the guide 14. It is movable only in the operation axis of the breaking part and the horizontal direction.

The connection between the double motion mechanism 10 and the driving side is made by, for example, as shown in FIG. 2, attaching a fastening ring 23 to the nozzle 8, providing the fastening ring 23 with a hole through which the end of the driving side connecting rod 11 is inserted, and fastening the driving side fastening screw 24 with a nut.

Figure 3:
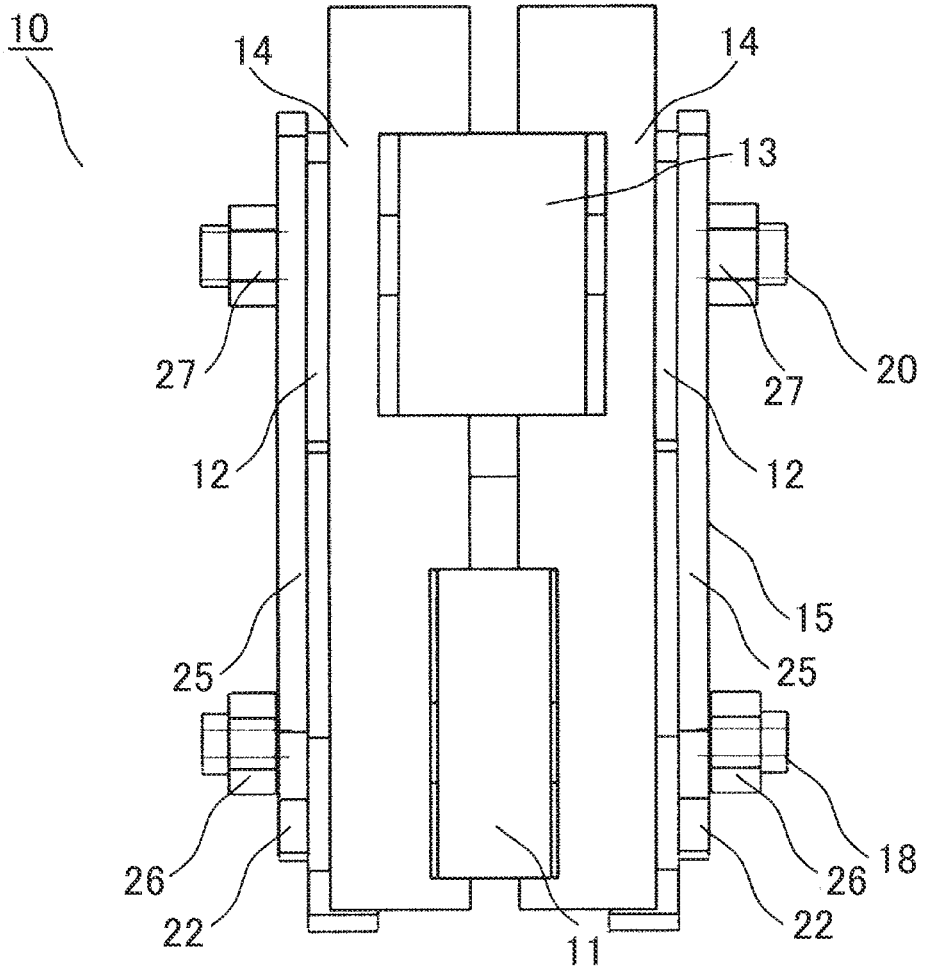
FIG. 3 is a front view of the double motion mechanism of the gas circuit breaker according to the embodiment of the present invention.
Figure 4:
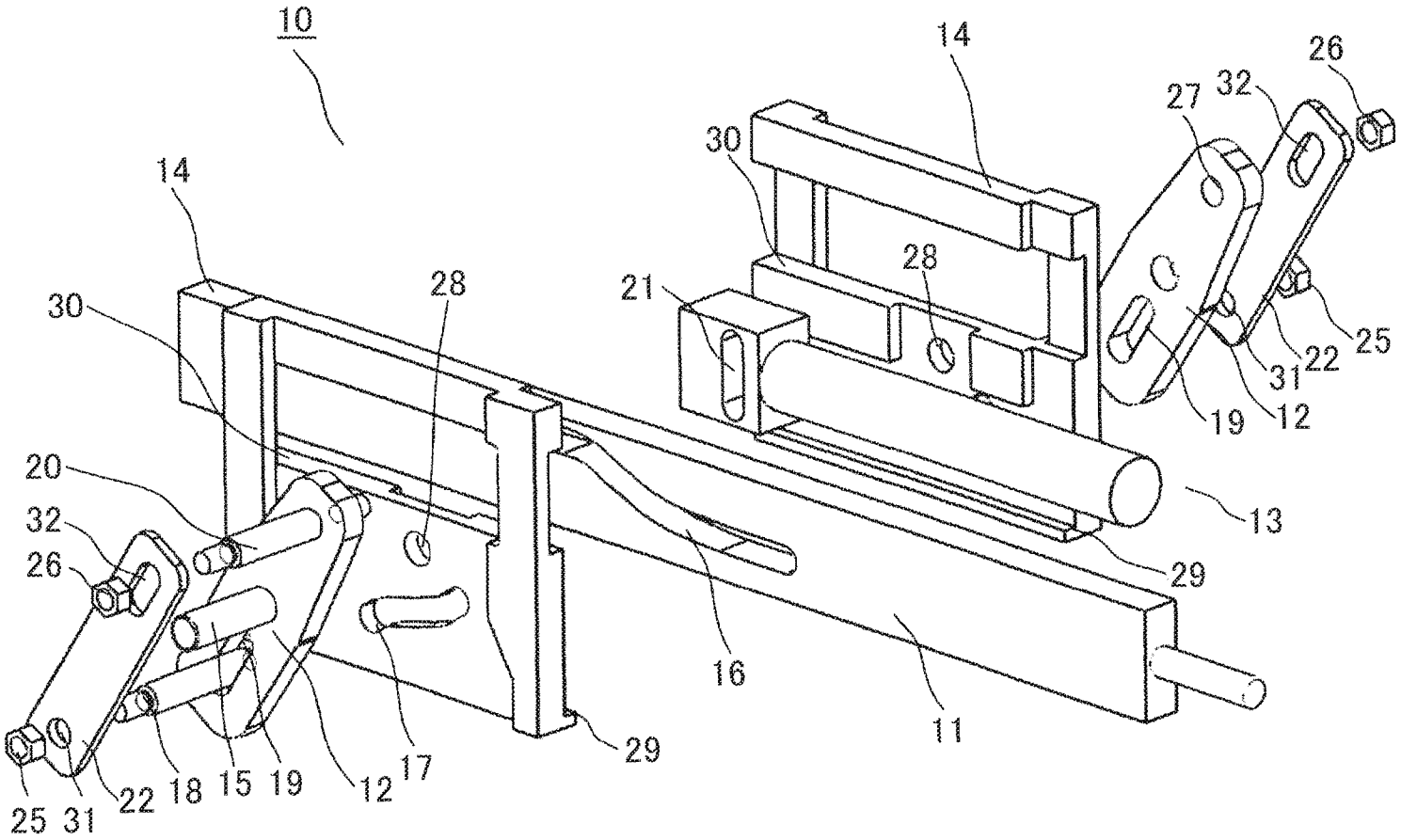
FIG. 4 is an exploded perspective view of the double motion mechanism of the gas circuit breaker according to the embodiment of the present invention.

FIG. 3 shows a front view of the double motion mechanism in the embodiment of the present invention. Further, FIG. 4 shows an exploded perspective view of the double motion mechanism in the embodiment of the present invention.

Two same-shaped levers 12 are attached to the outside of the guide 14.

The driving side movable pin 18 is inserted through the second grooved cam 17 in the guide 14, the first grooved cam 16 in the driving side connecting rod 11, and the third grooved cam 19 in the lever 12.

The driven side movable pin 20 is inserted through the lever 12 (lever driven side hole 27) and the driven side connecting rod 13 (guide groove 21).

Since a position retaining member 22 acts as a stopper, the lever fixing pin 15 may be merely inserted in the lever fixing pin hole 28.

The driving side movable pin 18 is not fixed to any part of the lever 12, the guide 14 and the driving side connecting rod 11. It is freely movable in the respective grooves of the first grooved cam 16, the second grooved cam 17, and third grooved cam 19. However, in the driving side movable pin 18 having high operation freedom, rotation may occur about two axes orthogonal to the movable pin axis. With this rotation, it is possible that the contact between the pin and the three types of grooves differs on the both right and left sides in FIG. 3, and a local contact force is increased. To avoid it, the position retaining member 22 with a round hole 31 cut in one side and an elongate hole 32 cut in the other side is used. The position retaining member 22 is provided on the both outer sides of the lever 12. The driving side movable pin 18 is fitted in the round hole 31 of the position retaining member 22. The driven side movable pin 20 is inserted through the elongate hole 32 of the position retaining member 22. The driving side movable pin 18 is fastened with a nut 25. The driven side movable pin 20 is fastened with a nut 26. Note that an arbitrary fastening member or a stopper member such as a split pin or a cap may be used in place of the nut 25 or the nut 26.

The position retaining member 22 forms a mating structure with the driving side movable pin 18 and the round hole 31. Accordingly, the driven side movable pin 20, which suppresses inclination in accordance with inclination accompanying the rotation about two axes vertical to the pin axis of the driving side movable pin 18, and is inserted through the elongate hole 32, forms a mating structure with the lever driven side hole 27. The rotation of the lever 12 about the two axes orthogonal to the movable pin axis of the driving side movable pin 18 and/or the driven side movable pin 20 is suppressed to a minimum amount. With the contact among the position retaining member 22, the lever 12 and the nut 26, the inclination amount of the driving side movable pin 18 is suppressed to a slight amount.

At this time, not to cause excessive sliding resistance among the driving side movable pin 18, the position retaining member 22 and the respective contact members, it is desirable that the lengths of the cylinder parts of the driving side movable pin 18 and the driven side movable pin 20 are equal to or longer than the thickness of the guide 14, the lever 12, and the position retaining member 22 in the lamination direction.

In the present embodiment, as shown in FIG. 3, it is possible to realize a space-saving double motion mechanism by overlaying the first grooved cam 16 and the second grooved cam 17 in the axis direction of the driving side movable pin 18. Further, the driving side movable pin 18 is not fixed to any part having a grooved cam, and the rotation about two axes orthogonal to the pin axis is suppressed with the position retaining member 22. Since it is possible to mitigate the excessive force to act on the driving side movable pin 18, it is possible to realize a highly reliable double motion mechanism.

Further, the design freedom of the curve of the first grooved cam is high. It is therefore possible to easily change the design in correspondence with model with different breaking part structure and breaking method. It is possible to design an optimum curve shape to ensure breaking performance. Further, since it is possible to freely set the length and region of the linear portion, it is possible to move the driven side only in an arbitrary time domain.

This operation is especially effective in small capacitive current breaking. In small capacitive current breaking, it is necessary that an inter-electrode breakdown voltage at each breaking time is higher than a recovery voltage. Since the inter-electrode breakdown voltage depends on inter-electrode distance at each time, it is necessary to cover inter-electrode distance as long as possible in a short time.

In the present embodiment, the shape of the grooved cam of the double motion mechanism to realize a stroke characteristic necessary for small capacitive current breaking is shown. There are optimum stroke characteristics to various cutoff duties. They are realized by changing the shape of the connecting member 16 formed with an arbitrary curve in the present embodiment.

Further, it is possible to change the speed ratio of the driven side operation with respect to the driving side operation by adjusting one or more of positional relationship, a length, a direction, and a shape of the first linear portion 16A, the second linear portion 16C, and the connecting portion 16B of the first grooved cam, the second grooved cam 17, and the third grooved cam 19.

C. Modifications

Figure 5A:
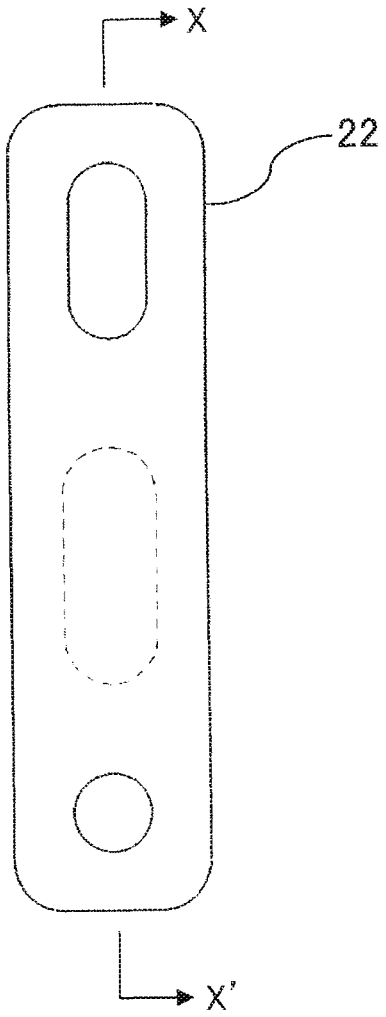
FIGS. 5A and 5B are explanatory diagrams of another embodiment of a position retaining member used in the double motion mechanism of the gas circuit breaker according to the embodiment of the present invention.
Figure 5B:
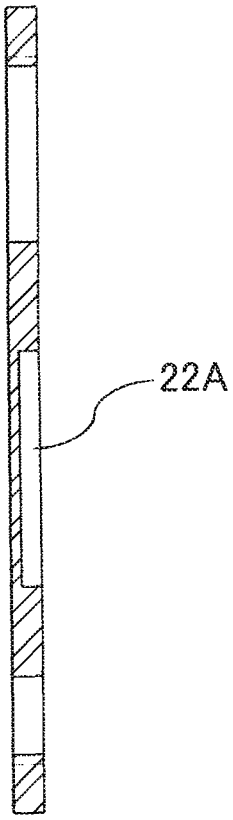

FIG. 5 are explanatory views of another embodiment of the position retaining member used in the double motion mechanism of the gas circuit breaker according to the embodiment of the present invention. FIG. 5(B) is an X-X' cross-sectional view of FIG. 5(A). In this example, the end of the lever fixing pin 15 is inserted in the position retaining member 22, which forms a concave member 22A slidable in a lengthwise direction. With this configuration, it is possible to further suppress the rotation about two axes vertical to the pin axis of the driving side movable pin 18 and/or the driven side movable pin 20 of the position retaining member 22.

Figure 6A:
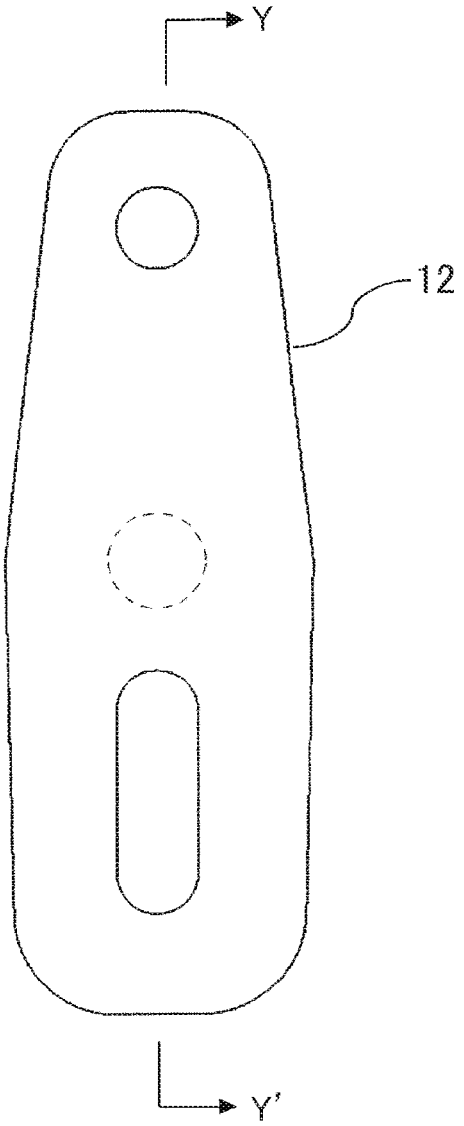
FIGS. 6A and 6B are explanatory diagrams of another embodiment of a lever used in the double motion mechanism of the gas circuit breaker according to the embodiment of the present invention.
Figure 6B:
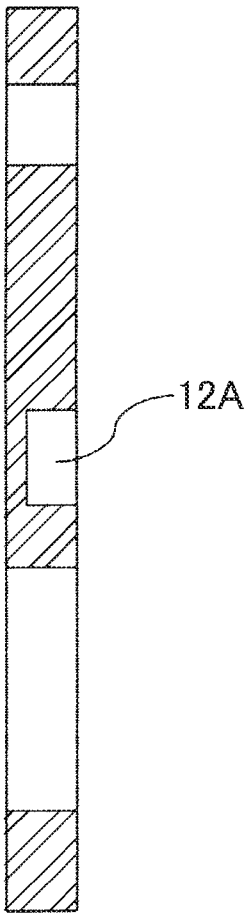

FIG. 6 are explanatory views of another embodiment of the lever used in the double motion mechanism of the gas circuit breaker according to the embodiment of the present invention. FIG. 6(B) is a Y-Y' cross-sectional view of FIG. 6(A). In this example, the lever 12 has a structure where the lever fixing pin 15 is not inserted through the lever 12 but has a concave member 12A through which the lever fixing pin is inserted in the middle. With this configuration, it is possible to solve contact/friction between the end of the lever fixing pin 15 and the position retaining member 22.

D. Note

Note that the present invention is not limited to the above-described embodiment but includes various modifications. For example, the above embodiment has been described in detail for explaining the present invention, and the invention is not necessarily limited to an embodiment having all the described constituent elements. Further, a part of constituent elements of an embodiment maybe replaced with those of another embodiment. Further, constituent elements of an embodiment may be added to those of another embodiment. Further, it is possible to perform addition/deletion/replacement with respect to a part of constituent elements of the respective embodiments with other constituent elements.

LIST OF REFERENCE SIGNS

1 . . . operating unit, 2 . . . driving side main electrode, 3 . . . driven side main electrode, 4 . . . driving side arcing contact, 5 . . . driven side arcing contact, 6 . . . shaft, 7 . . . mechanical compression chamber, 8 . . . nozzle, 9 . . . thermal expansion chamber, 10 . . . double motion mechanism, 11 . . . driving side connecting rod, 12 . . . lever, 13 . . . driven side connecting rod, 14 . . . guide, 15 . . . lever fixing pin, 16 . . . first grooved cam, 16A . . . first linear portion, 16B . . . connecting portion, 16C . . . second linear portion, 17 . . . second grooved cam, 18 . . . driving side movable pin, 19 . . . third grooved cam, 20 . . . driven side movable pin, 21 . . . guide groove, 22 . . . position retaining member, 23 . . . fastening ring, 24 . . . driving side fastening screw, 25 . . . movable pin fastening nut, 26 . . . moving pin fastening nut, 27 . . . lever driven side hole, 28 . . . lever fixing pin hole, 29 . . . driving side guide, 30 . . . driven side guide, 31 . . . position retaining member round hole, 32 . . . position retaining member elongate hole

The invention claimed is:

1. A gas circuit breaker comprising:

a driving side electrode, having a driving side main electrode and a driving side arcing contact, connected to an operating unit, and provided in a closed tank;

a driven side electrode, having a driven side main electrode and a driven side arcing contact, being provided oppositely to the driving side electrode in the closed tank; and a double motion mechanism, wherein the double motion mechanism has:

a driving side connecting rod, with a cut-in first grooved cam, that receives a driving force from the driving side electrode;

a driven side connecting rod connected to the driven side arcing contact;

a guide, with a cut-in second grooved cam, that holds the driving side connecting rod and the driven side connecting rod to move inside;

two levers, with a cut-in third grooved cam and a round lever driven side hole, provided on the both outer sides of the guide, to connect the driven side connecting rod and the driving side connecting rod, and operate the driven side connecting rod in an opposite direction with respect to an operation of the driving side connecting rod;

a lever fixing pin to fix the two levers mutually rotatably;

a driving side movable pin communicated with the first grooved cam of the driving side connecting rod, the second grooved cam of the guide, and the third grooved cam of the respective two levers;

a driven side movable pin communicated with the lever driven side hole in a position on the opposite side to the driving side movable pin with the lever fixing pin between the pins; and two position retaining members, respectively provided on the outer side of the two levers, with a cut-in round hole through which the driving side movable pin is inserted and an elongate hole through which the driven side movable pin is inserted, to suppress rotation of the driving side movable pin about two axes vertical to a pin axis.

2. The gas circuit breaker according to claim 1, wherein the elongate hole of the position retaining member is opposed to the round hole of the lever driven side hole of the lever, and the round hole of the position retaining member is opposed to the third grooved cam of the lever, to form a mating structure with the lever and the position retaining member.

3. The gas circuit breaker according to claim 2, wherein the driving side movable pin is inserted through the third grooved cam of the lever, the first grooved cam of the driving side connecting rod, and the round hole of the position retaining member.

4. The gas circuit breaker according to claim 3, wherein an elongate hole is provided in the driven side connecting rod, and wherein the driven side movable pin is inserted through the round hole of the lever driven side hole of the lever, the elongate hole of the driven side connecting rod, and the elongate hole of the position retaining member.

5. The gas circuit breaker according to claim 1, wherein the lever has a hole through which the driving side movable pin is inserted.

6. The gas circuit breaker according to claim 5, wherein the position retaining member has a concave member in which an end of the driving side movable pin is inserted and slid.

7. The gas circuit breaker according to claim 1, wherein the lever has a concave member in which the driving side movable pin is inserted.

8. The gas circuit breaker according to claim 1, wherein the driving side movable pin and the driven side movable pin are respectively fastened or stopped with a nut, a cap, a split pin or another fastening member or stopper member.

9. The gas circuit breaker according to claim 1, wherein the lever is rotated, the driven side connecting rod is driven in an opposite direction to the driving side connecting rod, and the driven side arcing contact connected to the driven side connecting rod is driven in an opposite direction to the driving side arcing contact of the driving side electrode connected to the driving side connecting rod, by moving the driving side movable pin in the first to third grooved cams with an operation of the driving side connecting rod.

10. The gas circuit breaker according to claim 1, wherein the first grooved cam of the driving side connecting rod has a first linear portion, a second linear portion provided on a different axis with respect to the first linear portion, and a connecting portion that connects the first linear portion and the second linear portion, and wherein a displacement range of the first grooved cam in a vertical direction is within the displacement range of the second grooved cam in the vertical direction and the displacement range of the third grooved cam in the vertical direction.

11. The gas circuit breaker according to claim 10, wherein when the driving side movable pin moves on the first linear portion and the second linear portion, the lever stands still and/or is not rotated, and wherein when the driving side movable pin moves on the connecting portion, the lever rotates with the lever fixing pin as a fulcrum.

12. The gas circuit breaker according to claim 10, wherein when the driving side movable pin moves on the connecting portion, the driving side movable pin moves along the respective second grooved cam and the third grooved cam.

13. The gas circuit breaker according to claim 10, wherein upon an opening operation, the driving side movable pin moves in the second linear portion and the connecting portion, and the first linear portion in a first direction, and upon a closing operation, the driving side movable pin moves in the first linear portion, the connecting portion, and the second linear portion in a second direction opposite to the first direction.

14. The gas circuit breaker according to claim 10, wherein one or more of positional relationship, a length, a direction, and a shape of the first linear portion, the second linear portion, the connecting portion of the first grooved cam, the second grooved cam, and the third grooved cam, are previously determined based on speed ratio of a driven side operation with respect to a driving side operation.

* * * * *